United States Patent [19]

Diehl

[11] Patent Number: 4,963,937

[45] Date of Patent: Oct. 16, 1990

[54] DEVELOPMENT APPARATUS

[75] Inventor: Elizabeth D. Diehl, Fairport, N.Y.

[73] Assignee: Xerox Corporation, Stamford, Conn.

[21] Appl. No.: 324,794

[22] Filed: Mar. 17, 1989

[51] Int. Cl.[5] ..... G03G 15/09

[52] U.S. Cl. ..... 355/251; 118/657; 355/253

[58] Field of Search ..... 355/259, 256, 260, 251, 355/252, 253; 118/661, 659, 656, 657, 658

[56] References Cited

U.S. PATENT DOCUMENTS

| | | | |
|---|---|---|---|
| 3,724,943 | 4/1973 | Draugelis et al. | 355/251 X |
| 3,753,419 | 8/1973 | Fukushima et al. | 118/637 |
| 4,410,260 | 10/1983 | Kuehnle | 355/256 |
| 4,537,494 | 8/1985 | Lubinsky et al. | 355/251 |

*Primary Examiner*—Arthur T. Grimley
*Assistant Examiner*—Sandra L. Hoffman
*Attorney, Agent, or Firm*—H. Fleischer; J. E. Beck; R. Zibelli

[57] ABSTRACT

An apparatus in which a latent image recorded on a belt extending in a direction transverse to a horizontal plane is developed with a developer material. At least two developer rollers are mounted, at least partially, in the chamber of a housing storing a supply of developer material. The developer rollers are spaced from one another and have different diameters. The spacing between each of the developer rollers and the diameters of each of the developer rollers is selected so that a plane tangential to the lowermost region of each of the developer rollers is substantially parallel to the horizontal plane.

12 Claims, 2 Drawing Sheets

DEVELOPMENT APPARATUS

Figure 1:
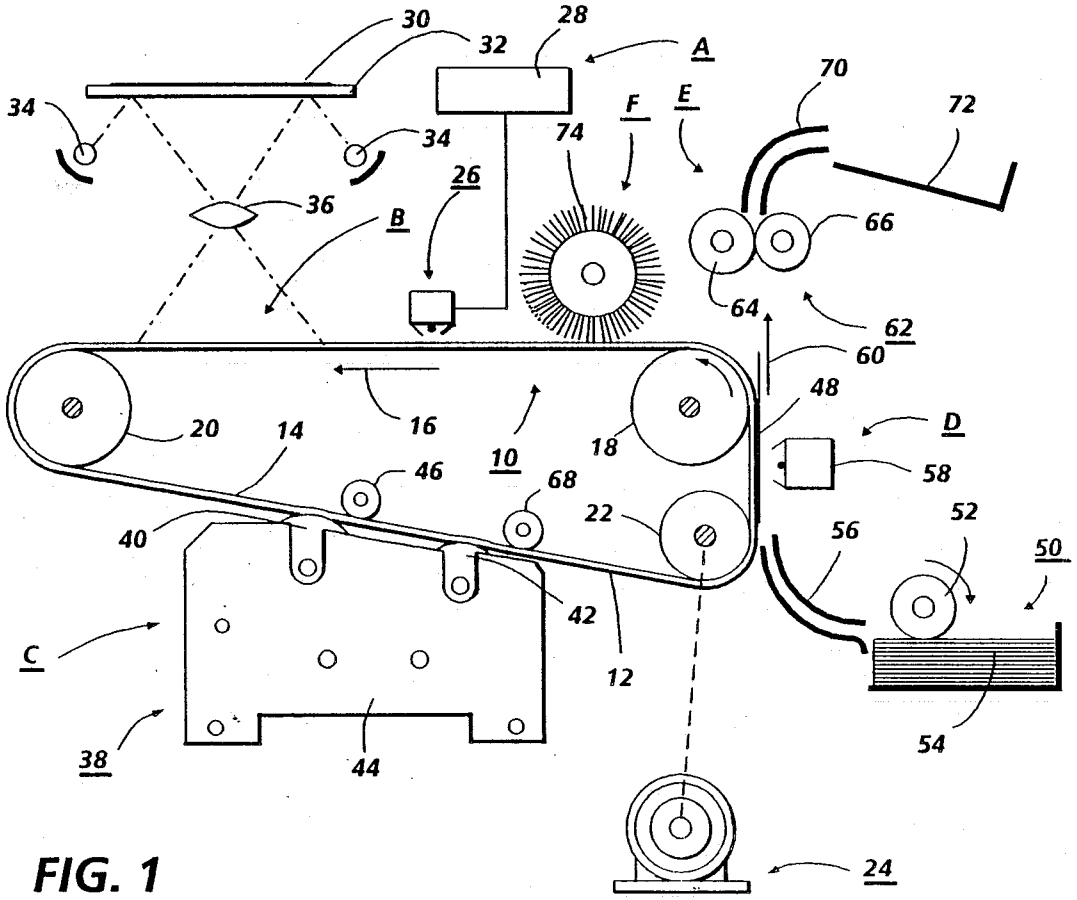

This invention relates generally to an electrophotographic printing machine, and more particularly concerns an apparatus for developing a latent image.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer mixture into contact therewith. A common type of developer material comprises carrier granules having toner particles adhering triboelectrically thereto. This two-component mixture is brought into contact with the photoconductive surface. The toner particles are attracted from the carrier granules to the latent image. This forms a toner powder image on the photoconductive surface which is subsequently transferred to a copy sheet. Finally, the toner powder image is heated to permanently fuse it to the copy sheet in image configuration.

A high speed commercial printing machine of this type uses a magnetic brush development system for developing the latent image. The magnetic brush system generally employs several developer rollers for transporting the developer material closely adjacent to the photoconductive surface. Augers are usually used to mix and disperse the developer material throughout the developer housing. Balancing this type of mixing is critical to the function of the development system. An unbalanced system causes high driving torque, low admix of fresh toner particles, and difficult pickup of the developer material by the magnetics of the developer roll. In addition, the developer rolls must properly interface with the photoconductive member. The photoconductive member must be precisely spaced or wraped with respect to each developer roll in order to achieve acceptable copy quality. Most multi-roll development systems have developer rolls of equal diameters. In a printing machine employing a photoconductive belt inclined relative to the horizontal, these requirements conflict with one another. When the development system is tilted so that the developer rolls interface correctly with the photoconductive belt, developer material balance can not be achieved. The developer material tends to fill the lowermost auger first. Accordingly, it is desirable to be capable of achieving developer material balance in a development system wherein the developer rollers are positioned properly relative to an inclined photoconductive belt. Various types of development systems have been devised. The following disclosures appear to be relevant:

US-A-3,753,419; Patentee: Fukushima et al.; Issued: Aug. 21, 1973.

US-A-4,410,260; Patentee: Kuehnle; Issued: Oct. 18, 1983.

US-A-4,537,494; Patentee: Lubinsky et al.; Issued: Apr. 27, 1985.

The relevant portions of the foregoing disclosures may be briefly summarized as follows:

US-A-3,753,419 discloses a development system using a liquid developer material. The system has at least two pairs of nip rollers, at least one pair of endless belts suspended between selective nip rollers, and a plurality of development electrode rollers having smaller diameters than the nip rollers. The diameters of the carrier and suppressing rollers may differ from each other to provide a contact area with a sheet which ensures stable transport thereof.

US-A-4,410,260 describes a toning apparatus having a developing roller and a pair of guide rollers. The guide rollers provide a bow in the belt as it is moved over the developing roller to provide a substantial tensile stress so that the toner material is evenly spread onto the belt. The apparatus uses a liquid toner.

US-A-4,537,494 discloses an electrophotographic printing machine having an inclined photoconductive belt. The development system employs a plurality of developer rollers adjacent the photoconductive belt. The developer rollers may be of different diameters with the photoconductive belt being wrapped about a portion thereof.

In accordance with one aspect of the present invention, there is provided an apparatus for developing, with developer material, a latent image recorded on a belt extending in a direction transverse to a horizontal plane. The apparatus includes a housing defining a chamber for storing a supply of developer material. At least two developer rollers are mounted, at least partially, in the chamber of the housing for transporting developer material to the belt to develop the latent image recorded thereon. Each of the developer rollers is closely adjacent to the belt. The developer rollers are spaced from one another and have different diameters with the spacing between each of the developer rollers and the diameters of each of the developer rollers being selected so that a plane tangential to the lowermost region of each of the developer rollers is substantially parallel to the horizontal plane.

Pursuant to another aspect of the present invention, there is provided an electrophotographic printing machine of the type in which a development apparatus develops, with developer material, an electrostatic latent image recorded on a photoconductive belt extending in a direction transverse to a horizontal plane. The improved development apparatus includes a housing defining a chamber for storing a supply of developer material. At least two developer rollers are mounted, at least partially, in the chamber of the housing for transporting developer material to the photoconductive belt to develop the latent image recorded thereon. Each of the developer rollers is closely adjacent to the photoconductive belt. The developer rollers are spaced from one another and have different diameters. The spacing between each of the developer rollers and the diameters of each of the developers is selected so that a plane tangential to the lowermost region of each of the developer rollers is substantially parallel to the horizontal plane.

Figure 2:
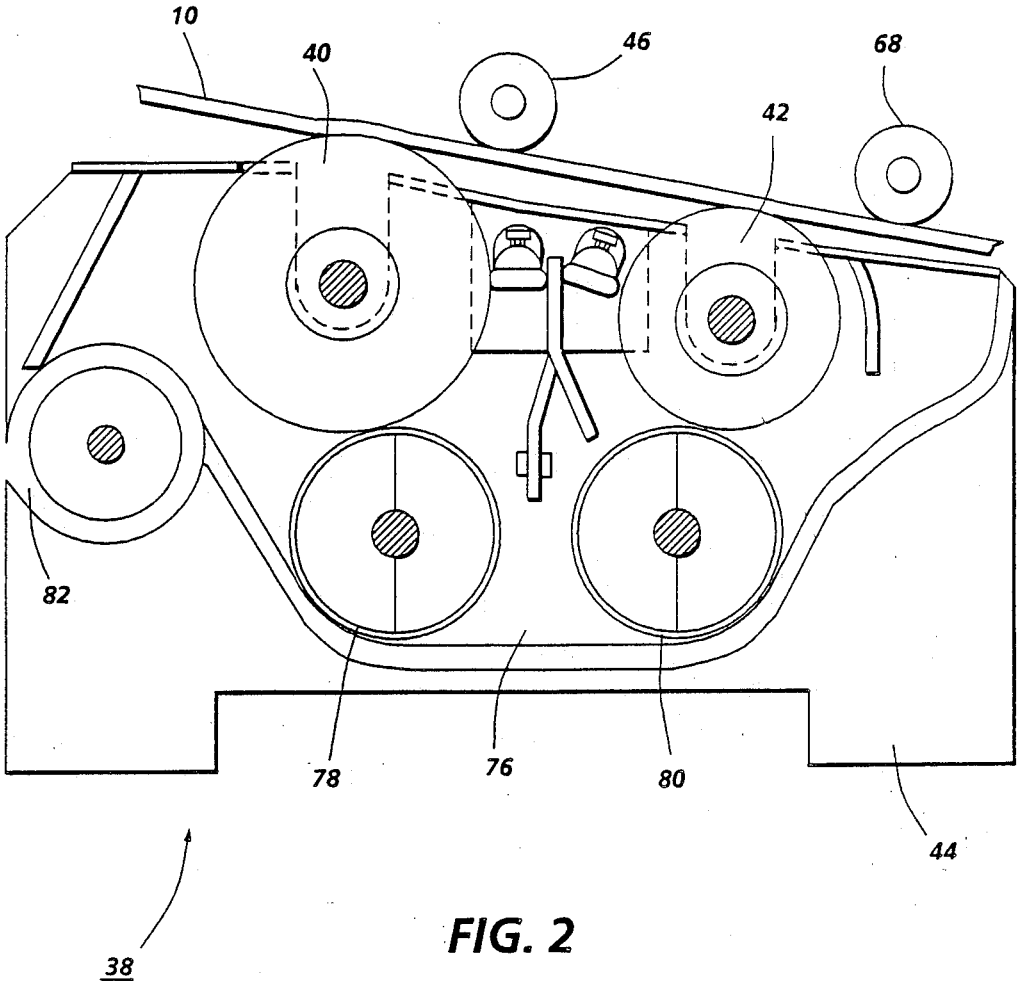

Other features of the present invention will become apparent as the following description proceeds and upon reference to the drawings, in which:

FIG. 1 is a schematic elevational view of an illustrative electrophotographic printing machine incorporating a development apparatus having the features of the present invention therein; and FIG. 2 is a side elevational view showing the development apparatus used in the FIG. 1 printing machine While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Referring initially to FIG. 1, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. As shown, belt 10 is inclined with respect to a horizontal plane perpendicular to the gravity vector, i.e. belt 10 extends in a direction transverse to the horizontal plane. At development station C, a magnetic brush development system, indicated generally by the reference numeral 38, advances developer material into contact with the latent image. Preferably, magnetic brush development system 38 includes two magnetic brush developer rollers 40 and 42. Rollers 40 and 42 advance developer material into contact with the latent image. These developer rollers form a brush of carrier granules and toner particles extending outwardly therefrom. The latent image attracts toner particles from the carrier granules forming a toner powder image thereon. Developer rollers 40 and 42 are mounted, at least partially, in the chamber of developer housing 44. The chamber in developer housing 44 stores a supply of developer material therein. Developer rollers 40 and 42 are mounted, at least partially, in the chamber of developer housing 44. Guide rollers rollers 46 and 68 deflect belt 10 so that a portion of belt 10 is wrapped about a region of the exterior circumferential surface of rollers 40 and 42 to form extended development zones about each of the developer rollers. The detailed structure of development system 38 will be described hereinafter with reference to FIG. 2.

With continued reference to FIG. 1, after the electrostatic latent image is developed, belt 10 advances the toner powder image to transfer station D. A copy sheet 48 is advanced to transfer station D by sheet feeding apparatus 50 Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image formed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 60 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development system of the present invention therein.

Referring now to FIG. 2, there is shown development system 38 in greater detail. As shown thereat, development system 38 includes a housing 44 defining a chamber 76 for storing a supply of developer material therein. Developer rollers 40 and 42 are mounted in chamber 76 of housing 44. The diameter of developer roller 40 is larger than the diameter of developer roller 42. The spacing between the centers of developer rollers 40 and 42 is a function of the diameters of the developer rollers. The spacing is selected so that for the selected diameters, a plane tangential to the lowermost portion of developer roller 40 and developer roller 42 will be substantially parallel to the horizontal plane perpendicular to the gravity vector. Thus, developer rollers 40 and 42 will be closely adjacent to belt 10, i.e. a portion of belt 10 is wrapped about developer rollers 40 and 42, with the lowermost portions of the developer rollers being tangential to a plane substantially parallel to the horizontal plane. Guide rollers 46 and 68 engage the backside of belt 10 and position belt 10 so that a portion thereof wraps about a region of developer roller 46 forming an extended development zone ranging from about 5° to about 25°. Another portion of belt 10 wraps about a region of developer roller 42 forming an extended development zone ranging from about 5° to about 25°. By way of example, if belt 10 is inclined at 6.656° with respect to the horizontal plane and the diameters of the developer rollers are 50.8 millimeters and 42 millimeters, respectively, the spacing between the developer rollers must be 75.663 millimeters in order to position the lowermost portion of the exterior circumferential surface of each of the developer rollers tangent to the plane substantially parallel to the horizontal plane. Alternatively, if the diameters of the developer rollers are 63 millimeters and 42 millimeters, respectively, the spacing between the developer rollers is 180.559 millimeters. If the inclination of belt 10 changes, the spacing between the developer rollers must also change. For example, if belt 10 is inclined at 11.150° with respect to the horizontal plane and the diameters of the developer rollers are once again 63 millimeters and 42 millimeters, respectively, the spacing between the developer rollers must be 106.54 millimeters. It is thus clear that in order to have the lowermost portion of the developer rollers tangential to a plane substantially parallel to the horizontal plane when the photoconductive belt is inclined relative to the horizontal plane, the diameters of the developer rollers must be different, and for a fixed belt inclination, the distance between developer roller centers varies as a function of the diameters of the developer rollers. Preferably, developer rollers 40 and 42 each include a non-magnetic tubular member made preferably from aluminum and having the exterior circumferential surface thereof roughened. An elongated magnet is positioned interiorly of and spaced from the the tubular member. The magnet is mounted stationarily and generates a low magnetic field in the development zone to permit high agitation of the developer material thereat. The tubular member rotates to advance the developer material adhering thereto into the developement zone where the toner particles are attracted from the carrier granules to the latent image recorded on photoconductive surface 12 of belt 10.

With continued reference to FIG. 2, augers 78 and 80 are located in chamber 76 of housing 44. Each of the augers includes a tube having apertures therein and a helical screw mounted rotatably in the interior of the tube. Developer material enters the tube at one end region and is advanced to the various apertures in the tube so as to be discharged therefrom onto the respective developer roller. As the developer material is advanced, it is mixed. In this way, the developer material is mixed and dispersed with the admix and uniformity being improved. Augers 78 and 80 are substantially equal in size. Auger 78 transports developer material to developer roller 40 and auger 80 transports developer material to developer roller 42. The centers of augers 78 and 80 lie in a common plane that is substantially parallel to the horizontal plane. Inasmuch as housing 44 and chamber 76 are level, the developer material flow in each of the augers can be balanced. Hence, auger 78 transports substantially the same amount of developer material as auger 80. In this way, the mixing of the developer material though out chamber 76 is substantially uniform and each developer roller has substantially the same quantity of developer material transported thereto. A third auger 82 may also be mounted in chamber 76 of housing 44 to further improve the mixing of the developer material.

As successive electrostatic latent images are developed, the toner particles within the developer material are depleted. A toner dispenser (not shown) stores a supply of toner particles. The toner dispenser is in communication with chamber 76 of housing 44. As the concentration of toner particles in the developer material is decreased, fresh toner particles are furnished to the developer material in the chamber from the toner dispenser. The augers in the chamber of the housing mix the fresh toner particles with the remaining developer material so that the resultant developer material therein is substantially uniform with the concentration of toner particles being optimized.

In recapitulation, it is evident that compensation for the inclination of the photoconductive belt is achieved by selecting the diameters of the developer rollers and the spacing therebetween. This enables the developer rollers to be precisely spaced or have the photoconductive belt wrapped about a portion thereof while still achieving balanced developer material flow throughout the development system.

It is, therefore, apparent that there has been provided in accordance with the present invention, a development system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claims:

1. An apparatus for developing with developer material a latent image recorded on a belt extending in a direction transverse to a horizontal plane, including:

a housing defining a chamber for storing a supply of developer material;

at least two developer rollers mounted, at least partially, in the chamber of said housing for transporting developer material to the belt so as to develop the latent image recorded thereon with each of said developer rollers being closely adjacent the belt, said developer rollers being spaced from one another and having different diameters with the spacing between each of said developer rollers and the diameters of each of said developers being selected so that a plane tangential to the lower periphery both of said developer rollers is substantially parallel to the horizontal plane.

2. An apparatus according to claim 1, wherein the the spacing between each of said developer rollers varies as a function of the diameters of each of said developer rollers.

3. An apparatus according to claim 2, further including a pair of augers disposed in the chamber of said housing with one of said pair of augers being operatively associated with one of said developer rollers and the other one of said pair of augers being operatively associated with the other one of said developer rollers, said pair of augers being adapted to mix the developer material stored in the chamber of said housing and transport developer material to said developer rollers.

4. An apparatus according to claim 3, wherein said pair of augers are substantially equal in size.

5. An apparatus according to claim 4, wherein the developer material flow in each of said pair of augers is substantially balanced.

6. An apparatus according to claim 2, wherein a portion of the belt is wrapped about a region of at least one of said developer rollers forming an extended development zone.

7. An electrophotographic printing machine of the type in which a development apparatus develops with developer material an electrostatic latent image recorded on a photoconductive belt extending in a direction transverse to a horizontal plane, wherein the improved development apparatus includes:

a housing defining a chamber for storing a supply of developer material;

at least two developer rollers mounted, at least partially, in the chamber of said housing for transporting developer material to the photoconductive belt to develop the electrostatic latent image recorded thereon with each of said developer rollers being closely adjacent the photoconductive belt, said developer rollers being spaced from one another and having different diameters with the spacing between each of said developer rollers and the diameters of each of said developers being selected so that a plane tangential to the lower periphery both of said developer rollers is substantially parallel to the horizontal plane.

8. A printing machine according to claim 7, wherein the the spacing between each of said developer rollers varies as a function of the diameters of each of said developer rollers.

9. A printing machine according to claim 8, further including a pair of augers disposed in the chamber of said housing with one of said pair of augers being operatively associated with one of said developer rollers and the other one of said pair of augers being operatively associated with the other one of said developer rollers, said pair of augers being adapted to mix the developer material stored in the chamber of said housing and transport developer material to said developer rollers.

10. A printing machine according to claim 9, wherein said pair of augers are substantially equal in size.

11. A printing machine according to claim 10, wherein the developer material flow in each of said pair of augers is substantially balanced.

12. A printing machine according to claim 8, wherein a portion of the photoconductive belt is wrapped about a region of at least one of said developer rollers forming an extended development zone.

* * * * *